United States Patent [19]

McGeoch, deceased et al.

[11] 4,217,735

[45] Aug. 19, 1980

[54] TOOL SHARPENING DEVICE

[76] Inventors: James McGeoch, deceased, late of Barnegat, N.J.; by Dorothy C. McGeoch, executrix, 110 Harborage Pl., Barnegat, Ocean County, N.J. 08005

[21] Appl. No.: 957,421

[22] Filed: Nov. 2, 1978

[51] Int. Cl.[2] ..... B24B 3/48

[52] U.S. Cl. ..... 51/158

[58] Field of Search ..... 51/157, 158, 159, 64, 51/69

[56] References Cited

U.S. PATENT DOCUMENTS

| | | | |
|---|---|---|---|
| 751,077 | 2/1904 | Jacques | 51/158 |
| 1,979,741 | 11/1934 | Hangi | 51/158 |
| 2,131,626 | 9/1938 | Keith | 51/158 |
| 2,435,671 | 2/1948 | Clark | 51/158 |
| 2,644,279 | 7/1953 | Stankovich | 51/157 |
| 2,703,951 | 3/1955 | Smith | 51/158 |

*Primary Examiner*—Harold D. Whitehead

*Attorney, Agent, or Firm*—Louis V. Schiavo

[57] ABSTRACT

The tool sharpening device comprises a base assembly holding a sharpening stone and mounting a tower assembly. The tower assembly may be shifted manually back and forth along the base assembly and the sharpening stone held therein. The tower assembly carries a platen subassembly, which may be angularly adjusted relative to the surface of the sharpening stone and shifted from side to side. Means are provided for mounting various types of tools on the platen for being sharpened by working the tool along and across the surface of the sharpening stone.

9 Claims, 14 Drawing Figures

TOOL SHARPENING DEVICE

BACKGROUND OF THE INVENTION

1. Field of the Invention

The present invention relates to a device for holding a woodworking tool of the flat chisel type having square or round cutting edges, or of the type having a radius at the cutting edge, such as gouges, during sharpening whereby the edges of the tool may be given a pre-selected angle.

2. Description of the Prior Art

In sharpening a woodworking tool, it is common for the operator to hold the tool in his hands to thereby support and guide it while working it over a stone to sharpen the cutting edge. However, to be truly sharp the cutting edge of the tool must be precisely uniform. Accordingly, it is apparent that this practice cannot be satisfactory for even the most proficient of operators cannot manage to make each sharpening stroke a duplicate of the others.

Frequently, tools are sharpened by working them over a rotating high speed grinding wheel. Very often the tool is overheated at the cutting edge, which destroys the temper of the steel. This makes it necessary to retemper the steel, which, of course, is a disadvantage since retempering steel requires a special skill which few craftsmen possess.

Whether the tool is worked over the surface of a bench type sharpening stone or over a rotating high speed grinding wheel, the method whereby the tool is held in the operator's hands and thereby supported and guided while being worked over the stone or wheel results in excessive wear due to the hit and miss method of trying to develop a satisfactory cutting edge.

Devices for holding straight edge cutting tools for being worked over stones to sharpen the cutting edges are known. However, the height of the tool at the rear is adjusted to change the sharpening angle with the cutting edge resting on the stone. As the cutting edge is worn during the sharpening process, the angle is changed. This results in a curved instead of a straight surface behind the cutting edge. Accordingly, the tool is not sharpened properly.

SUMMARY OF THE INVENTION

An important object of the present invention is to provide a tool sharpening device which is not dependent upon the skill of the operator for guiding the tool during the sharpening process.

Another object of the present invention is to provide such a device which may be utilized to furnish the tool with a cutting edge which is precisely uniform.

Still another object of the invention is to provide such a device which may be utilized to furnish the tool with a cutting edge which is precisely uniform without destroying the temper of the steel.

A further object of the present invention is to provide such a device which prolongs the useful life of the tool by mounting it for successive duplicate sharpening strokes, thereby producing a cutting edge which is precisely uniform, with a minimum number of sharpening strokes and without excessive wear.

A still further object of the present invention is to provide such a device which holds the tool at the same angle during the sharpening process thereby to afford a straight instead of a curved surface behind the cutting edge.

DESCRIPTION OF THE PREFERRED EMBODIMENT

Figure 3:
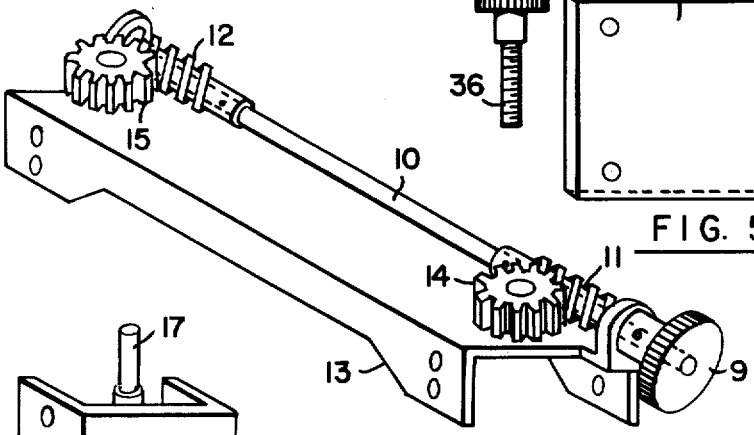
FIGS. 2 and 3 together afford an exploded perspective view of the tower assembly and the platen subassembly looking at the front and at one side of the tower assembly, a portion of the tower assembly being broken away to expose certain features.
Figure 5:
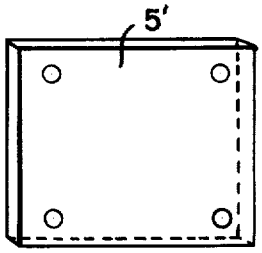
FIG. 5 is a perspective view of a clamp plate.

The following description is directed to the specific embodiment of the invention disclosed in the drawings. It is not addressed to the scope of the invention, which may be practiced in a variety of forms.

Figure 1:
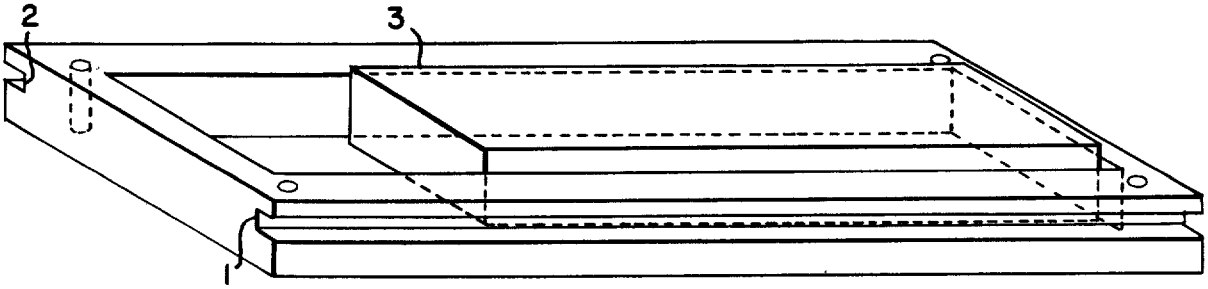
FIG. 1 is a perspective view of the base assembly.
Figure 10:
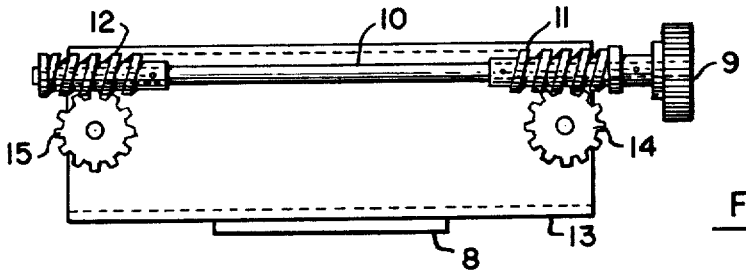
FIG. 10 is a view looking down on the top of the tower assembly.
Figure 8:
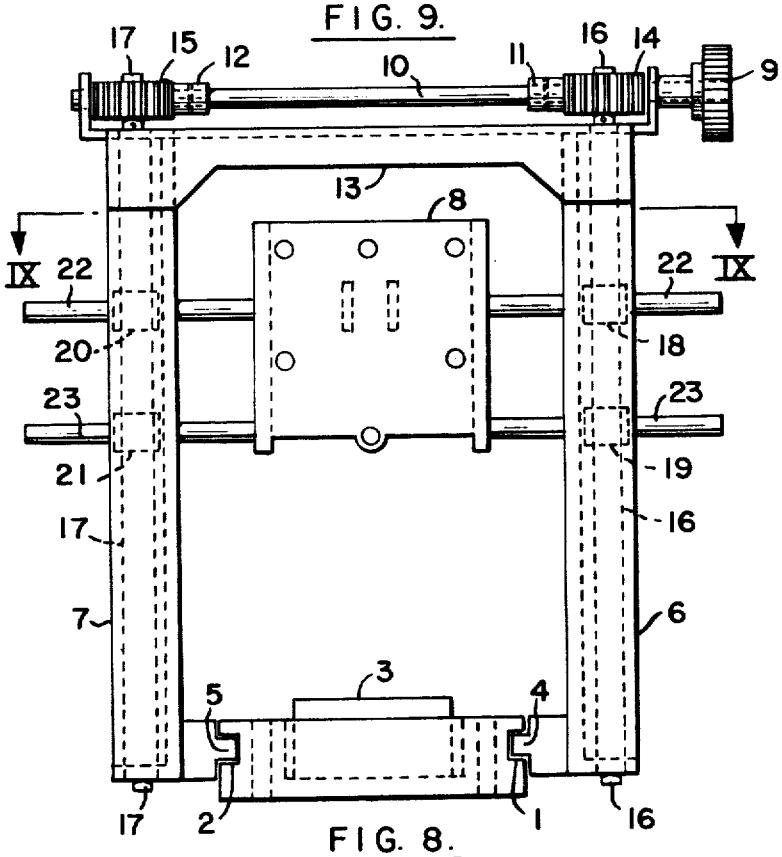
FIG. 8 is a front view of the device fully assembled as in FIG. 7.
Figure 7:
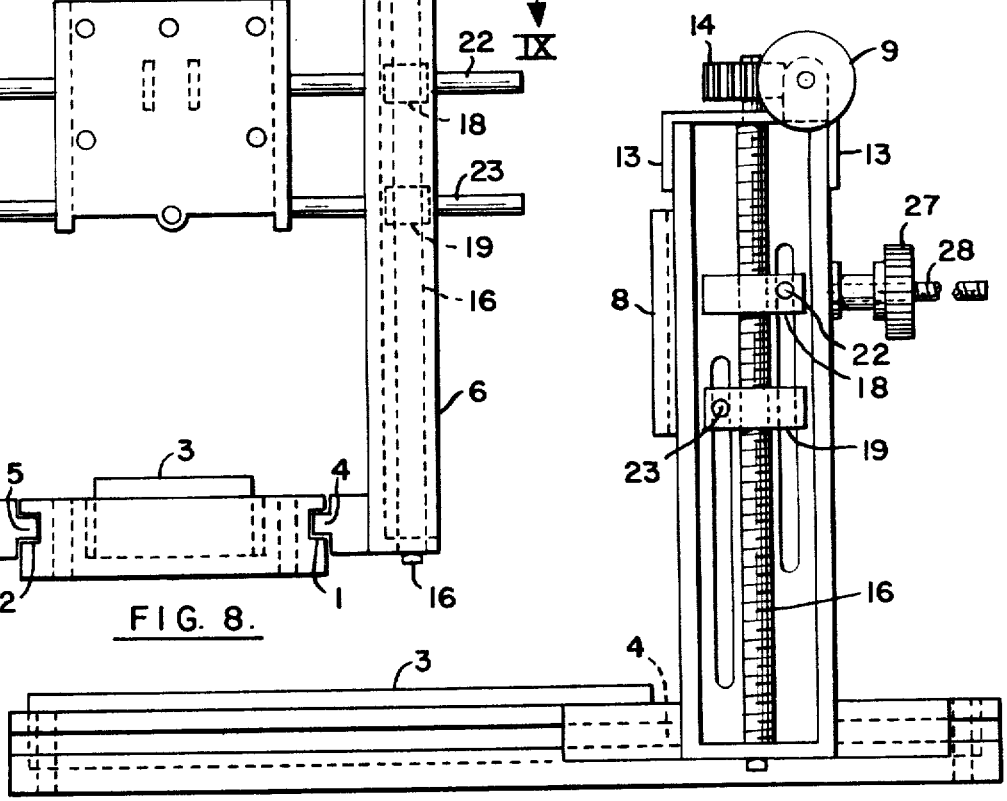
FIG. 7 is a view looking at one side of the device fully assembled.

Referring particularly to FIGS. 7, 8 and 10, basically the tool sharpening device comprises a base assembly mounting a tower or carriage assembly which in turn carries a platen subassembly. Now referring particularly to FIG. 1, the base assembly is provided with a pair of grooves 1 and 2 respectively on opposite sides thereof and extending the full length of the base assembly for accommodating a pair of opposed tongues 4 and 5 respectively at the lower extremities of the towers 6 and 7, shown in FIG. 2. A sharpening stone 3 is nested in a well formed in the base assembly. The stone abutts one end wall of the well and is held there, as by an angle clip (not shown). The base assembly is provided with holes, one in each corner thereof, to facilitate bolting it to a bench for greater stability of the device during use.

Figure 2:
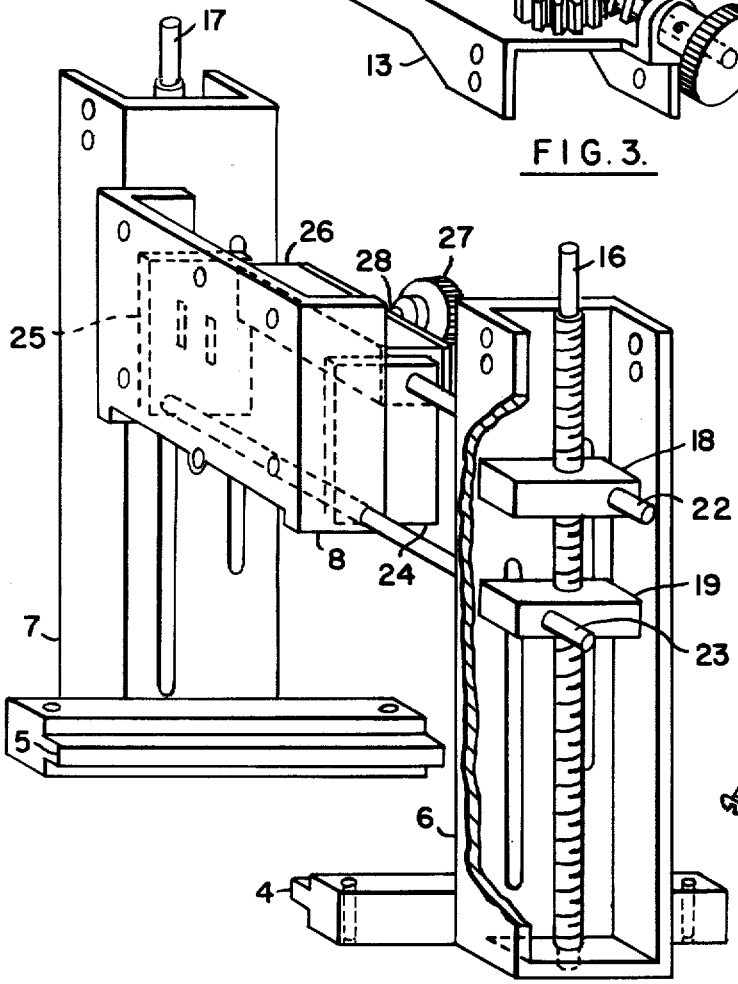

Referring particularly to FIG. 2, the towers 6 and 7 are fabricated respectively to the right and left hand. The tower 6 is shown with one side cut away for greater clarity. The upper ends of the towers 6 and 7 are interconnected by a brace 13, shown in FIG. 3 exploded upwards from the upper extremities of the towers 6 and 7. The tower assembly as a whole is in the form of an inverted U, having tongues 4 and 5 respectively engaging slidably in the grooves 1 and 2 of the base assembly. Accordingly, the tower assembly and the platen subassembly carried thereby may be moved manually back and forth repeatedly over the base assembly and the sharpening stone 3 nested therein. In the event that it is decided to use an electrically driven belt sander to move the tower assembly and platen subassembly back and forth the base assembly is not used. Instead, the tower assembly is bolted to the side plates of a belt sander in a suitable manner (not shown).

Referring particularly to FIGS. 2 and 3, the platen subassembly is disposed between the towers 6 and 7 and is carried by elevating rods 22 and 23. The height of the platen subassembly above the sharpening stone 3 may be adjusted by turning an elevation adjustment knob 9. The knob rotates a shaft 10 and a pair of worm gears 11 and 12 mounted on the shaft. The shaft 10 is supported by a pair of lugs turned up from the top of the brace 13 and is suitably secured in any suitable manner against axial shifting movement. The worm gears 11 and 12 respectively engage spur gears 14 and 15 mounted on the upper extremities of a pair of elevating twin screws 16 and 17 secured in any suitable manner against axial shifting movement. The screw 16 is threaded through elevating blocks 18 and 19 in the tower 6, and the screw 17 is threaded through elevating blocks 20 and 21 in the tower 7. These blocks are provided with holes which receive the elevating rods 22 and 23. Thus, when the knob 9 is turned, the gears 11, 12, 14 and 15 rotate causing the screws 16 and 17 to turn. Thereupon, the blocks 18, 19, 20 and 21 are elevated or lowered, depending upon the direction in which the knob 9 is turned. Thus the rods 22 and 23, which pass through the blocks 18, 19, 20 and 21 and suitable elongated openings in the towers 6 and 7 carry the platen subassembly to the desired elevation.

Figure 4:
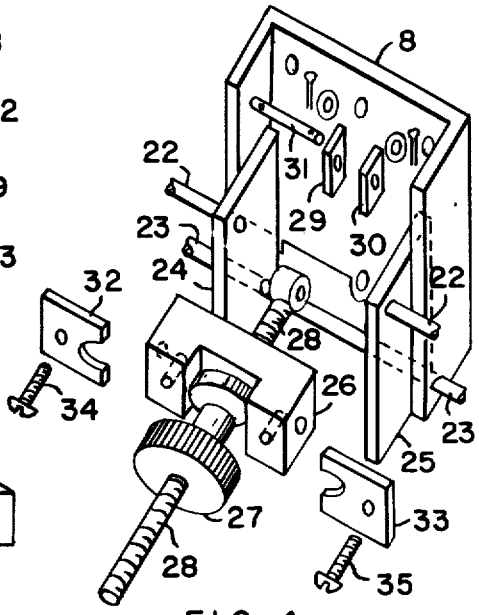
FIG. 4 is an exploded perspective view of the platen subassembly looking at the back and one side thereof.
Figure 9:
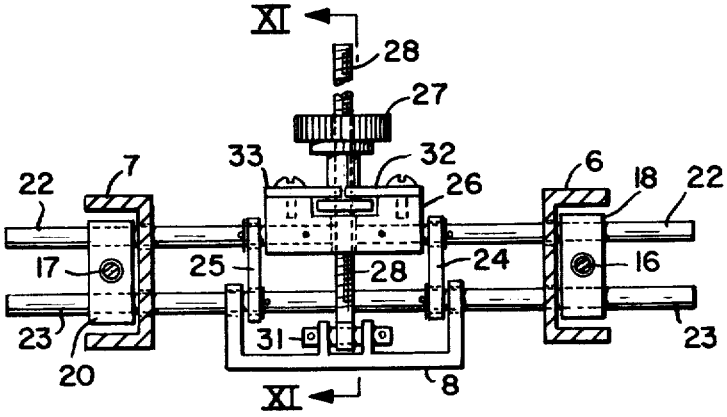
FIG. 9 is a section on lines IX—IX in FIG. 8.
Figure 11:
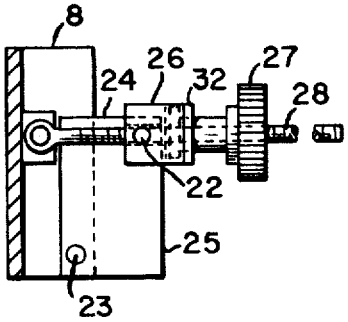
FIG. 11 is a section on lines XI—XI in FIG. 9.

Referring particularly to FIGS. 2, 4, 7, 8, 9 and 11, the rod 22 (in two coaxially related sections, as shown) passes through the blocks 18 and 20, elongated slots in the towers 6 and 7, a pair of platen linkage plates 24 and 25 and into opposite ends of a platen angle adjustment knob retaining block 26. Each section of the rod 22 is pinned to the block 26. The elevating or pivot rod 23 passes through the elevating blocks 19 and 21, elongated slots in the towers 6 and 7, the platen 8 and the platen linkage plates 24 and 25. The rods 22 and 23 and the plates 24 and 25 afford a rigid frame, and the arrangement permits the top of the platen 8 to be tilted forward at an angle relative to the sharpening stone 3. Referring particularly to FIGS. 4, 9 and 11, it will be appreciated that with the shoulder of the platen angle adjustment knob 27 in the recess formed in the block 26, and with the retainer plates 32 and 33 in position, the knob 27 is secure against axial shifting movement. As a consequence, the eye bolt 28, which is threaded through the knob 27 and passes through the block 26 shifts axially forward or retracts when the knob 27 is turned. The block 26 is restrained from back and forth movement but free to turn about the axis of rod 22 as the eye bolt 28 moves forward and backward to move the top of the platen to which it is secured, as by a pin 31. The arrangement, as described, provides for angular adjustment of the platen.

On the outside of the platen linkage plates 24 and 25, where the rod 22 passes through, washers and cotters are used to hold the linkage plates 24 and 25 against the ends of the block 26. The arrangement locks the elevating rod 22 to the platen subassembly for lateral movement but permits rocking of the rod 22 about its axis. Washers and cotters are also used on the elevating rod 23 tightly to the inside of the linkage plates 24 and 25. With the arrangement described the platen subassembly may be shifted from side to side a substantial distance from the center, in either direction, between the towers 6 and 7, at any preset height. The blocks 19, 20, 21 and 22 tend to turn when the platen subassembly is shifted. However, they are prevented from doing so by virtue of being captured in the towers 6 and 7.

Figure 12:
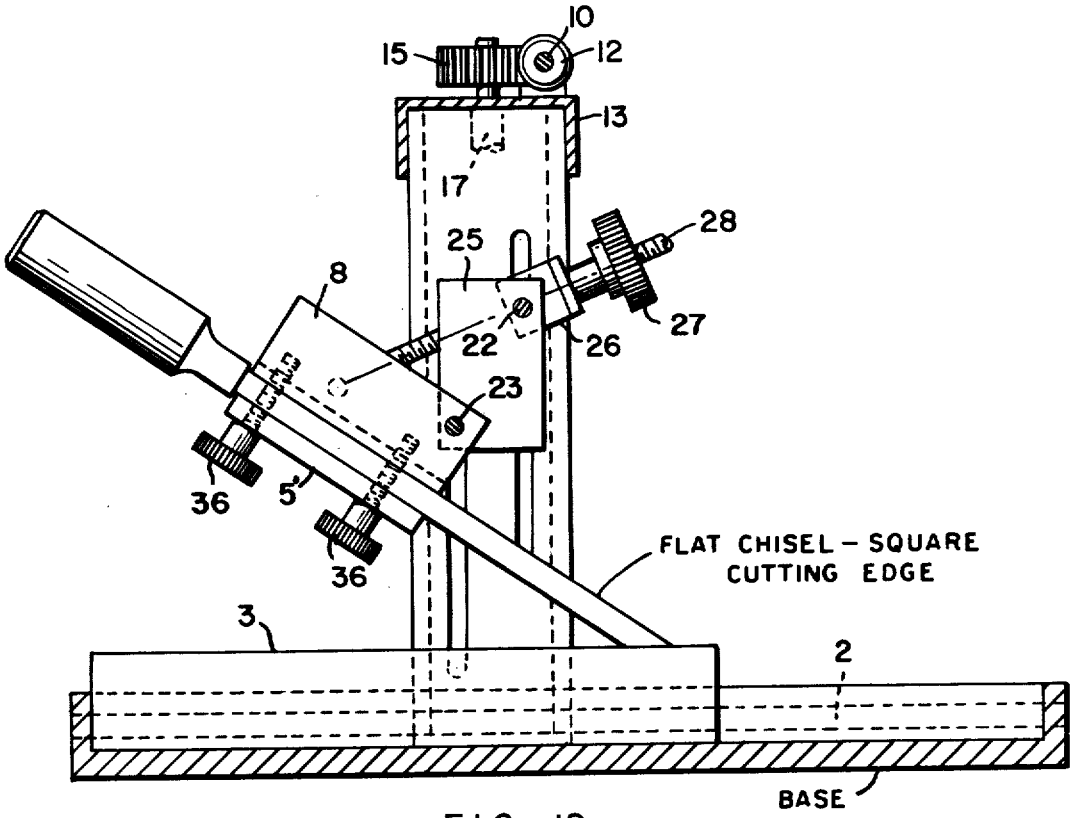
FIG. 12 is a vertical longitudinal section through the device showing a flat chisel with a square cutting edge clamped in position for being sharpened.

In the use of the tool sharpening device, flat tools with square cutting edges such as plane irons and wood chisels are clamped to the face of the platen 8 utilizing the platen clamp plate 5'. The plate 5' is secured by four shouldered thumb screws 36 which extend respectively through the corners of the plate 5' and thread into the platen 8. If the cutting edge is badly worn or damaged, the tool is held vertically ninety degrees to the surface of the sharpening stone 3. This is done by turning the knob 27 until the blade of the tool is at the required angle. Thus held, the tool is worked along and simultaneously across the surface of the stone 3. While this process is in progress, the feed of the tool to the surface of the stone 3 may be adjusted by turning the knob 9. Having the blade of the tool trued up, the knob 27 may be turned until the tool is at the required angle relative to the sharpening stone 3 (see FIG. 12). The knob 9 is turned to lower the tool as required to the surface of the stone 3 while the tool is worked along and across the surface of the stone. The vertical treatment of the cutting edge of the tool to true the same may be omitted if the tool is in relatively good condition.

Figure 6:
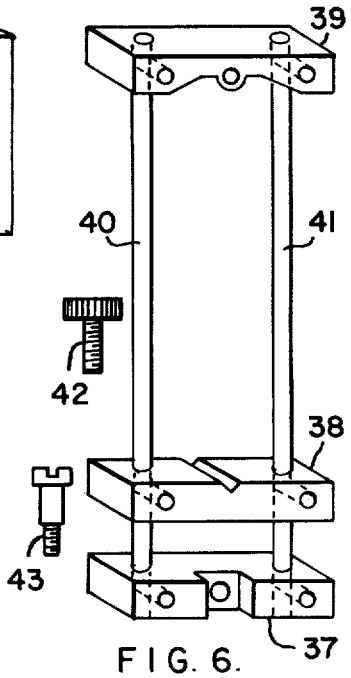
FIG. 6 is a perspective view of a pendulum assembly looking at the front and one side thereof.
Figure 13:
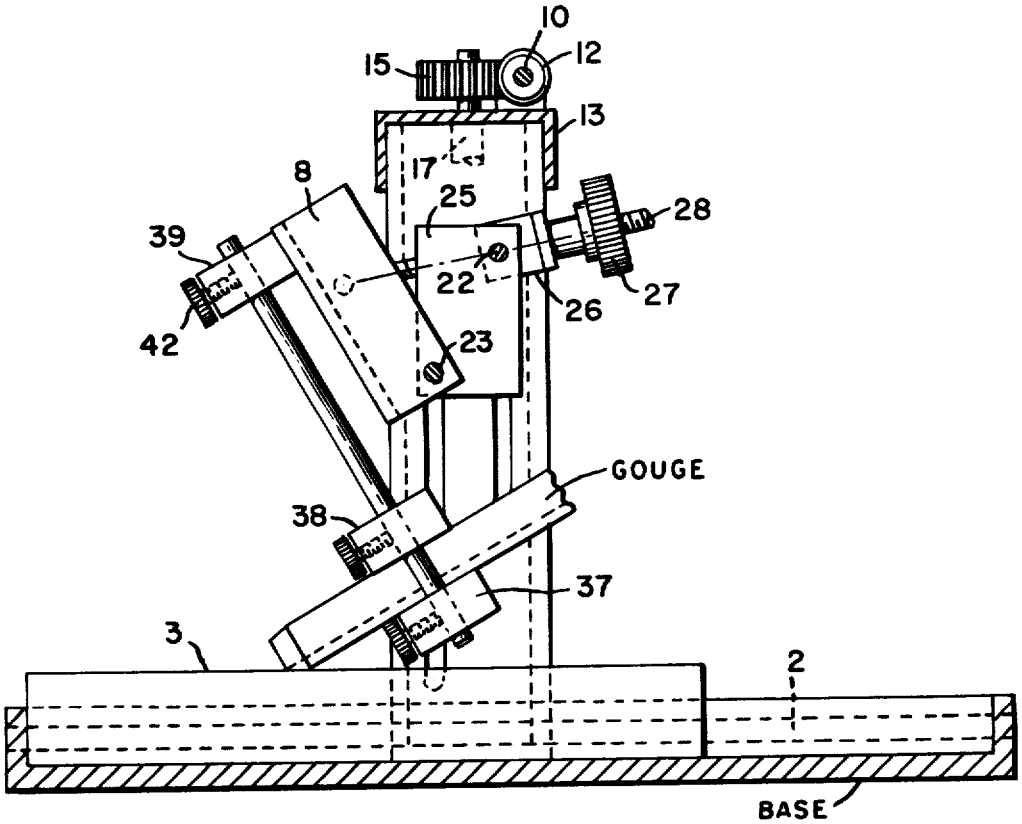
FIG. 13 is a vertical longitudinal section through the device showing a chisel having a radius at the cutting edge, such as a gouge, clamped in position for being sharpened.

Tools with a radius at the cutting edge and sharpened to an angle, such as gouges in their numerous forms, are sharpened utilizing the pendulum assembly shown in FIG. 6. If the tool is badly damaged or worn, the cutting edge may be given a near vertical treatment first. For this purose, the tool is clamped to the face of the platen 8 using the platen clamp plate 5', as described hereinbefore. Having the cutting edge trued up the operator may proceed as follows: Referring particularly to FIG. 6, the pendulum clamp block 37 is tightened to the bottom of the pendulum rods 40 and 41 by means of a pair of thumb screws 42 threaded through the front of the pendulum clamp block 37. The tool is then inserted between the pendulum clamp blocks 37 and 38 and the rods 40 and 41, with the surface to be sharpened at the bottom and the cutting edge protruding about an inch past the front of the blocks. Block 38, which has a neoprene facing on its underside is then moved down the rods 40 and 41 until the tool is firmly clamped between blocks 37 and 38. Another pair of the screws 42 are then threaded through the front of the block 38, as a consequence of which the tool is clamped between the blocks 37 and 38 at the longest travel, or the longest radius of the rods 40 and 41. The pendulum pivot block 39 is then placed on the rods 40 and 41, secured by a third pair of screws 42, and then attached to the platen 8 by means of slotted head and shouldered screw 43 threaded into the upper central hole in the platen 8. The block 39, with the rods 40 and 41, and the tool held at the bottom of the pendulum assembly (see FIG. 13) may now be swung from side to side in the manner of a pendulum with the tool held swinging in a radiius or circular arc over the surface of the stone 3. This radius can be changed by loosening the screws 42 at the front of the block 39 and raising the rods 40 and 41 to effect the desired different radius and then retightening the screws 42 in the block 39. As the radius is decreased, the knob 9 is turned to lower the tool to the surface of the sharpening stone 3. In each instance, the angle of the tool is finally adjusted by turning the knob 27. When the settings are as desired, the tool is worked along and across the surface of the stone 3 and at the same time swung to the set radius. With tools badly damaged or worn it will be neccessary to turn the knob 9 to feed the tool to the surface of the stone 3. Once set, the sharpening angle should not be changed. If tools in the radius range of ⅜ to 3 inches are to be sharpened, the screw 43 may be threaded into the lower central hole in the platen 8, instead of the upper central hole.

Figure 14:
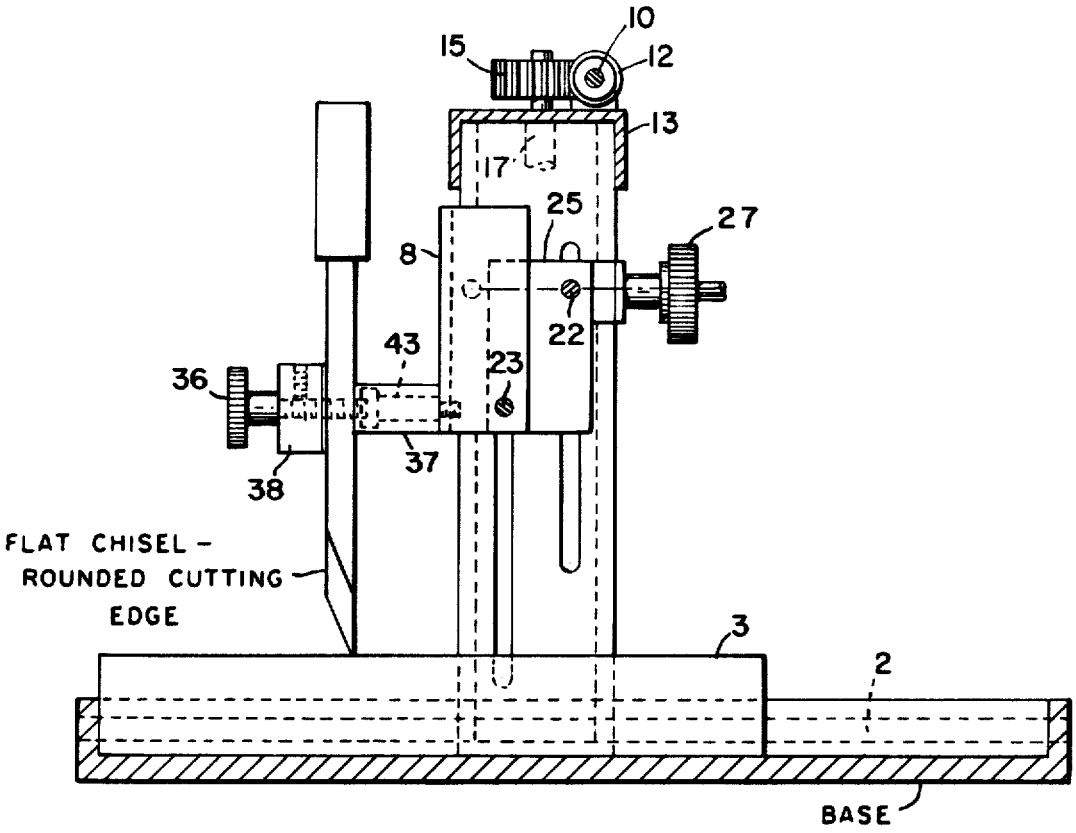
FIG. 14 is a vertical longitudinal section through the device showing a flat chisel with a rounded cutting edge clamped in position for being turned up.

Flat tools with a radius at their cutting edges and sharpened at an angle, such as bull nosed wood lathe turning tools, may be sharpened utilizing parts of the pendulum assembly shown in FIG. 6. If the tool is badly worn or damaged, the pendulum block clamp 37 is secured to the platen 8 by the shouldered screw 43 passed through the center hole in the slot in the front of the pendulum block 37 and threaded into the lower center hole in the platen. This permits the block 37 to turn on the shouldered portion of the screw 37. The tool is then placed with its flat side against the face of the block 37. Block 38 is then placed against the tool to be sharpened with its neoprene lined face towards the tool. Now a pair of thumb screws 36 are passed through the holes shown occupied by rods 40 and 41 in FIG. 6 and threaded into the face of the block 37. Thus the tool is clamped between blocks 37 and 38 and may be swung from side to side with the cutting edge swinging in a radius about the axis of the screw 43. The more the tool protrudes below the blocks, the longer the radius, and the closer the cutting edge is brought to the blocks, the shorter the radius. The tool, held between the blocks 37 and 38, is worked along and across the surface of the sharpening stone 3. At the same time it is swung from side to side to form the radius. This is done with the tool extending vertically, normal to the surface of the sharpening stone 3 (see FIG. 14). When the required radius is very short, in the order of ⅜ of an inch, it may be necessary to turn the sharpening stone 3 on its narrow edge and block it in position in the base assembly. After the cutting edge of the tool is established, the knob 27 is turned until the desired angle of the tool is set to sharpen the tool on an angle around the radius, as indicated generally hereinbefore.

While in accordance with the provisions of the patent statutes, I have illustrated and described the best form or embodiment of my invention known to me, it will be apparent to those skilled in the art that changes may be made in the form of the tool sharpening device described without departing from the spirit and scope of the invention.

What is claimed is:

1. In a device for sharpening chisel type tools, the combination comprising

A. a base member,

B. a sharpening stone mounted upon said base member and secured thereby with an abrasive surface facing upwardly, C. a carriage overlying said base member and reciprocable longitudinally thereof including (1) twin screws mounted upon said carriage respectively on opposite sides thereof and thereby disposed in laterally spaced parallel relation, (2) means for turning said screws at the same rate of speed, and (3) block means threaded respectively upon said screws for being elevated in unison when said screws are turned in one direction and lowered in unison when said screws are turned in the opposite direction, and D. means mounted upon said carriage for being reciprocated transversely of said base member, said means being operable for securing the tool to be sharpened, and for selectively raising and lowering it, and positioning it at a selected sharpening angle relative to the abrasive surface of said stone including (1) a rigid frame extending across said carriage, the opposite end portions of said frame being slidably received respectively by the associated block means, (2) a plate member mounted upon said frame for being rocked about an axis extending transversely of said base member, and (3) means interposed between said plate member and frame and operable for positioning said plate member at a selected angle relative to the abrasive surface of said stone.

2. The combination according to claim 1 wherein the block means comprises a pair of elevating blocks threaded upon each of said screws and thereby disposed in mutually overlying spaced relation, and the means reciprocable transversely of the base member comprises a plurality of laterally spaced parallel rods affording a rigid frame extending across said carriage, the corresponding end portions of said rods at each side of said carriage being slidably received respectively by the associated pair of said blocks, and the plate member mounted upon one of said rods for rocking about the axis thereof.

3. The combination according to claim 2 wherein the rigid frame comprises a pivot rod extending across the carriage, a pair of axially aligned and spaced rods conjointly extending across said carriage in laterally spaced parallel relation to said pivot rod, and a pair of laterally spaced parallel plates interconnecting said rods and forming therewith said rigid frame, the plate member is mounted upon said pivot rod for rocking about its axis, and an elongated element is pivoted at one end to said plate member at a point remote from said pivot rod and is threaded at its opposite end through another element captured in means interconnecting the opposite end portions of said axially aligned and spaced rods and thereby secured against axial movement relative to said rigid frame.

4. In a device for sharpening chisel type tools, the combination comprising

A. a base member,

B. a sharpening stone mounted upon said base member and secured thereby with an abrasive surface facing upwardly, C. a carriage overlying said base member and reciprocable longitudinally thereof, D. a plate member mounted upon said carriage for being reciprocated transversely of said base member, said plate member being operable for securing the tool to be sharpened, for selectively raising and lowering it, and for positioning it at a selected sharpening angle relative to the abrasive surface of said stone, and E. means for suspending the tool to be sharpened from said plate member for swinging about a horizontally extending axis in a circular arc over the abrasive surface of said sharpening stone in the manner of a pendulum.

5. The combination according to claim 4 wherein the means for suspending the tool to be sharpened from the plate member for swinging in an arc over the abrasive surface of the sharpening stone comprises a block pivotally connected to said plate member, a pair of rods depending from said pivot block, and means mounted upon said rods in underlying spaced relation to said pivot block and operable for clamping a tool therebetween, said rods and tool clamping means being shiftable for selectively adjusting the effective distance between said pivot block and tool clamping means.

6. The combination according to claim 5 wherein the tool clamping means comprises a pair of clamp blocks, said rods extend through said pivot and clamp blocks and are thereby disposed in laterally spaced parallel relation, and said clamp blocks are relatively shiftable for selectively adjusting the effective distance therebetween.

7. The combination according to claim 4 wherein the means for suspending the tool to be sharpened from the plate member for swinging in a circular arc over the abrasive surface of said sharpening stone comprises a set of block members disposed in mutually overlying relation, a pair of rods each extending through aligned openings in said block members, said rods being thereby disposed in laterally spaced parallel relation and said block members being shiftable along said rods to selected positions and releasably secured in said positions, and means associated with the uppermost one of said block members and operative for suspending said assembly of rods and block members from said plate member for swinging in a circular arc.

8. The combination according to claim 4 wherein the means for suspending the tool to be sharpened from the plate member for swinging in an arc over the abrasive surface of the sharpening stone comprises a block pivotally connected to said plate member, and a clamp block adapted for being releasably secured to said pivot block and operative for clamping the tool to be sharpened thereto.

9. The combination according to claim 8 wherein a shouldered element is threaded into the plate member and the pivot block is mounted upon said shoulder for rocking thereon.

* * * * *